United States Patent [19]

Weatherholt

[11] 4,105,557

[45] Aug. 8, 1978

[54] POOL SKIMMER

[76] Inventor: Brian R. Weatherholt, P.O. Box 4027, Bay Pines, Fla. 33504

[21] Appl. No.: 775,973

[22] Filed: Mar. 9, 1977

[51] Int. Cl.[2] ..... E04H 3/20

[52] U.S. Cl. ..... 210/169; 15/1.7; 210/242 R

[58] Field of Search ..... 15/1.7; 210/169, 242 R, 210/242 S

[56] References Cited

U.S. PATENT DOCUMENTS

| | | | |
|---|---|---|---|
| 2,989,185 | 6/1961 | Lombardi | 210/242 R |
| 3,306,448 | 2/1967 | Baker | 210/169 |
| 3,758,276 | 9/1973 | Bond et al. | 210/169 |
| 3,860,518 | 1/1975 | Henricksen | 210/169 |
| 3,928,202 | 12/1975 | Raubenheimer | 210/169 |
| 4,040,864 | 8/1977 | Steeves | 210/169 |

FOREIGN PATENT DOCUMENTS

| | | | |
|---|---|---|---|
| 1,372,879 | 11/1974 | United Kingdom | 210/169 |

*Primary Examiner*—Charles N. Hart
*Assistant Examiner*—Peter A. Hruskoci
*Attorney, Agent, or Firm*—Stein & Frijouf

[57] ABSTRACT

A swimming pool skimming device is disclosed for use with a pool sweeping device connected to a source of water pressure to propel the pool sweeping device within the swimming pool. The invention includes a body member having a specific gravity substantially less than one enabling the body member to provide buoyancy. The body member has a central cavity communicating with an open bottom in the body member. Means are provided for rigidily mounting the body member to the surface unit of the pool sweeping device to provide floatation thereto. A filter is established relative to the open body member with a plurality of water inputs communicating with the central cavity of the body member to enable surface water of the swimming pool to enter the central cavity and to exit through the open bottom with the filter collecting debris accompanying the surface water. The plurality of water inputs may include one way gates located on opposed sides of the body member enabling input of water into the central cavity during both forward and reverse movement of the skimming device. The skimming device is compatible for use with existing pool sweeping devices by replacing the standard float on the pool sweeping device with the pool skimming device. The foregoing abstract is merely a resume of one general application, is not a complete discussion of all principles of operation of applications, and is not to be construed as a limitation on the scope of the claimed subject matter.

9 Claims, 7 Drawing Figures

FIG. 1
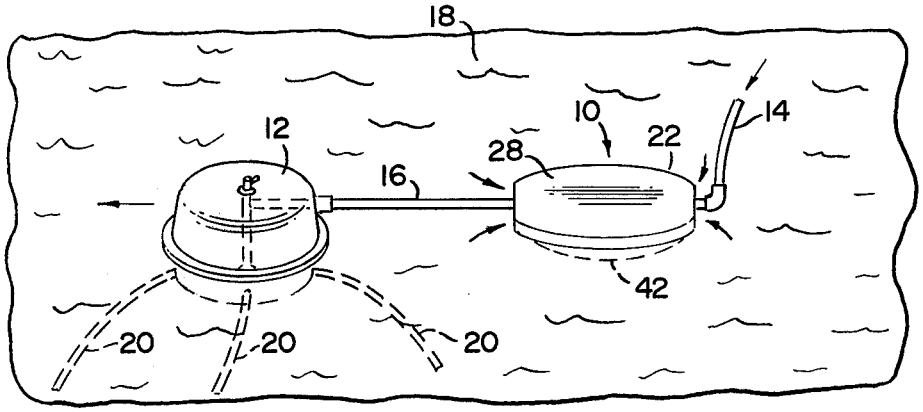
FIG. 2
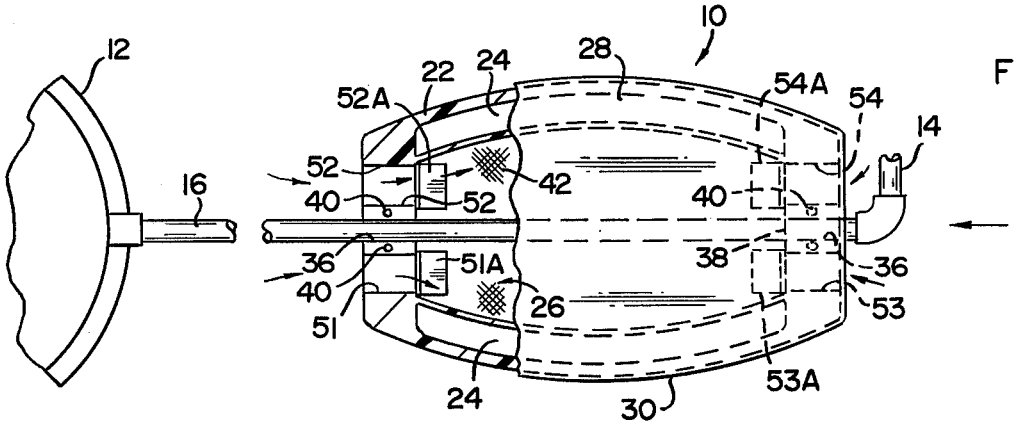
FIG. 3
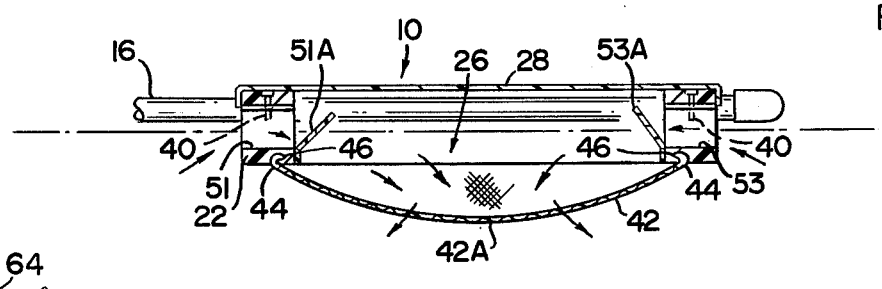
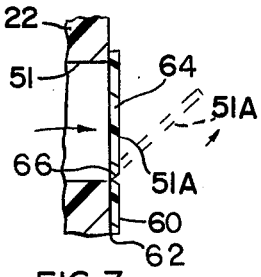
FIG. 7
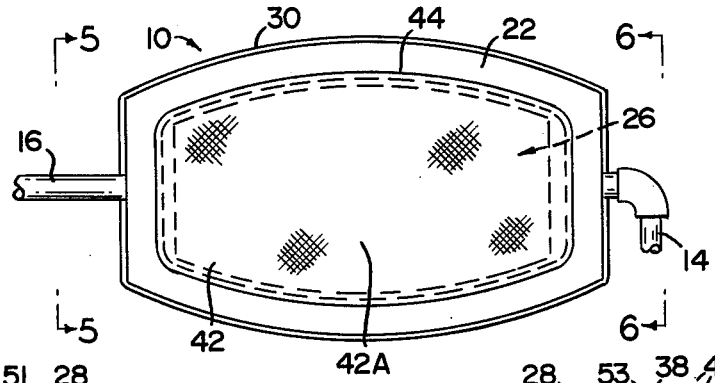
FIG. 4
FIG. 5
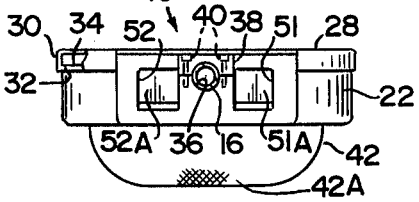
FIG. 6
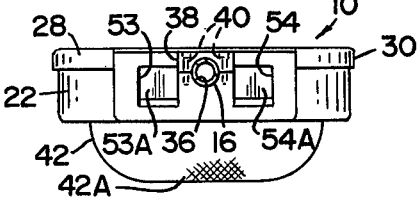

POOL SKIMMER

BACKGROUND OF THE INVENTION

1. Field of the Invention

This invention relates to liquid purification or separation and more particularly to structural installation of closed circulating systems such as aquariums or swimming pools.

2. Description of the Prior Art

In recent years swimming pools for home use have become more popular in view of the increased leisure and recreational time of the average family. Construction of swimming pools has been refined making their addition to existing family dwellings more realistic and desirable. However, the problem of maintenance of a swimming pool still presents a realistic concern and a deterrent for the acquisition of a swimming pool for many prospective buyers. Automatic chlorinators have eliminated much of the problems of maintaining a swimming pool from the bacteria and alga standpoint. However, the substantial problem of keeping the swimming pool free of foreign matter such as dirt, leaves and other debris still exists and represents the major task of pool maintenance.

Many pool sweeping devices have been available to the prior art for agitating the water within the pool for placing dirt particles into suspension within the pool water. Accordingly, the suspended particles are then filtered through the conventional filter system of the swimming pool. Many of these sweeping devices incorporate a flexible hose interconnecting the pool sweeping device to a source of water pressure to propel the pool sweeping device within the swimming pool. The pool sweeping device may have a single or a plurality of flexible hoses or arms which swing about by water pressure to agitate the water, and to scrap the sides and bottom of the pool for placing dirt particles in suspension within the swimming pool. These devices work satisfactory for dirt clinging to the bottom and the sides of the pool but were ineffective for removing debris located on the surface of the water of the swimming pool.

Some in the prior art have attempted to develop pool skimmers for operation with pool sweeping devices to collect the debris located on the surface water of the swimming pool. To date none of these devices have been successful since their incorporation with the pool sweeping device disburbs the natural action of the pool sweeping device by retarding the movement thereof.

Therefore it is an object of this invention to provide an apparatus which overcomes the aforementioned inadequacies of the prior art devices and provides an improvement which is a significant contribution to the advancement of the pertinent art.

Another object of this invention is to provide a swimming pool skimming device for use with a pool sweeping device having a flexible hose interconnecting the pool sweeping device to a source of water pressure to propel the pool sweeping device within the pool comprising a body member having a specific gravity substantially less than one enabling the body member to provide buoyancy with mounting means rigidly mounting the body member to the pool sweeping device to provide floatation of the surface unit of the pool sweeping device.

Another object of this invention is to provide a pool skimming device for use with a pool sweeping device wherein the pool skimming device includes a generally elliptically shaped body member having floatation chamber means therein and adapted for providing floatation to the pool sweeping device.

Another object of this invention is to provide a pool skimming device for use with a pool sweeping device having a body member with a central cavity communicating with an open bottom therein with a filter established relative to the open bottom and a plurality of water inputs communicating with the central cavity to enable the surface water of the swimming pool to enter the central cavity and to exit through the open bottom with the filter collecting debris accompanying the surface water.

Another object of this invention is to provide a pool skimming device for use with a pool sweeping device wherein the body member is generally elliptically shaped and comprises mounting means including a rigid conduit connecting the pool sweeping device to the flexible hose with a mounting aperture in opposite sides of the body member for receiving the rigid conduit.

Another object of this invention is to provide a pool skimming device for use with a pool sweeping device including a body member having a ridge extending thereabout with a filter having a support rim which is cooperable with the body member ridge in a snap locking engagement for mounting the filter to the body member.

Other objects and a fuller understanding of this invention may be had by referring to the summary of the invention, the description and the claims, taken in conjunction with the accompanying drawings.

SUMMARY OF THE INVENTION

The invention may be incorporated into a swimming pool skimming device for use with a pool sweeping device having a flexible hose interconnecting the pool sweeping device to a source of water pressure to propel the sweeping device within the pool. The invention includes a body member having a specific gravity substantially less than one enabling the body member to provide buoyancy. The body member has a central cavity communicating with an open bottom in the body member. Mounting means rigidly mounts the body member to the surface unit of the pool sweeping device to provide floatation to the pool sweeping device. A filter is established relative to the open bottom of the body member with a plurality of water inputs communicating with the central cavity of the body member to enable surface water of the swimming pool to enter the central cavity of the body member and to exit through the open bottom with the filter collecting debris accompanying the surface water.

The plurality of water inputs may include a plurality of one way inputs. In the preferred form, the one way gates are located on opposite sides of the body member. The filter may include a screen detachably mounted to the body member. In one form, the body member may include a ridge extending about the body member with the filter having a support rim extending about the filter. The support rim cooperates with the ridge in a body member in a snap locking engagement for mounting the filter means to the body member.

The invention may include a rigid conduit connecting the pool sweeping device to the flexible hose. Mounting apertures may be provided in opposed sides of the body member for receiving the rigid conduit with clamps securing the body member to the rigid conduit. The one way gate means may be located on each side of the mounting aperture for providing water input upon both forward and backward movement of the skimming device.

In a specific form of the invention the body member may be a generally elliptically shaped plastic member having a central cavity and floatation chamber means in the outer portion thereof. The body member may also have an open top communicating with the central cavity with a removable cover cooperable with the body member for covering the open top. The filter may include a screen having a curved region extending below the body member for facilitating the flow of water through the central cavity.

This invention accordingly comprises an apparatus possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is an elevational view of pool skimming device in use with a pool sweeping device within a swimming pool;

FIG. 2 is a top view of the pool skimming device shown in FIG. 1;

FIG. 3 is a side sectional view of the pool skimming device shown in FIG. 2;

FIG. 4 is a bottom view of the pool skimming device shown in FIGS. 1–3;

FIG. 5 is an end view along line 5—5 of the pool skimming device shown in FIG. 4;

FIG. 6 is an end view along line 6—6 of the pool skimming device shown in FIG. 4; and FIG. 7 is a magnified view of a portion of the device shown in FIG. 3.

DETAILED DESCRIPTION

FIGS. 1–7 show various views of the subject invention comprising a skimming device 10 for use with a pool sweeping device 12. A flexible hose 14 interconnects the pool sweeping device 12 through a rigid conduit 16 to a source of water pressure (not shown) to propel the pool sweeping device 12 within a swimming pool 18. The source of water pressure may be a conventional water outlet or may be a high pressure water source provided by a pressure pump. The high pressure water flows through flexible hose 14 and conduit 16 to a surface unit of the sweeping device 12 whereat the water is distributed to a plurality of sweeping arms 20 which propel the device 12 within the pool. The sweeping arms 20 agitate the pool water 18 and rub the internal surfaces of the pool to place debris in suspension within the swimming pool water 18.

The invention includes a body member 22 in this embodiment shown as a generally elliptically shaped unitary plastic member. The body member 22 has floatation chamber means 24 providing a specific gravity of substantially less than one enabling the body member 22 to provide buoyancy. The body member has a central cavity 26 communicating with an open bottom of the body member 22. The body member also has an open top communicating with the central cavity 26 of the body member 22. A removable cover means 28 is cooperable with the body member 22 for covering the open top. The cover means 28 is shown as a plastic member having resilient side means 30 with protrusion 32 in the side means 30 being receivable in a depression 34 within the body member 22. The protrusion 32 may extend along substantially all of the length of the side 30 enabling the cover 28 to be rapidly secured to the body member 22 in a snap locking engagement.

The skimming device 10 is rigidly mounted to the surface unit of the sweeping device 12 through the substantially rigid conduit 16. Aperture means 36 shown in FIGS. 5 and 6 are established in opposed sides of the body member 22 for receiving the rigid conduit 16 therein. Clamping means 38 shown as plastic members are secured to the body member 22 by threaded fasteners 40 in this embodiment. However, it is understood that the clamp means 38 may be secured by a snapping engagement with the body member 22 or the like. The aperture means 36, clamp means 38 and threaded fasteners 40 enable the device 10 to replace a conventional float which appears as standard equipment on existing pool sweeping devices 12. The instant structure enables the consumer to replace the float on existing pool sweeping devices to add additional benefit of a skimming device as will be hereinafter described.

The invention includes filter means 42 established relative to the open bottom of the body member 22. In this embodiment, filter means 42 includes a support rim 44 extending about the filter means 42. The support rim is insertable within a recess or ridge 46 in the body member 22 to removably secure the filter means 42 relative to the body member 22. The filter means 42 may be a metallic screen mesh having a curved region 42A extending below the body member 22. The filter element 42 may be removed from the bottom of the body member 22 for cleaning and inspection.

The device 10 includes a plurality of water input means 51–54 communicating with the central cavity 26 of the body member 22. The water input means enables surface water from the swimming pool 18 to enter the central cavity 26 to exit through the open bottom with the filter means 42 collecting debris accompanying the surface water as indicated by the arrows. Input channel 51 and 52 are located on opposed sides of conduit 16 whereas input channels 53 and 54 are located on opposed sides of conduit 16. Each of the input channels 51–54 includes gate means 51A–54A respectively. The gate means are shown as one way gates for enabling only water input through input channels 51 and 52 when the device 10 moves toward the left in FIGS. 1–3. Input channels 53 and 54 enable only water input when the device 10 moves toward the right in FIGS. 1–3. FIG. 3 shows both one way gates 51A and 53A in the open position enabling water input to the central cavity 26.

FIG. 7 is a magnified view of a portion of FIG. 3 showing in greater detail the closed and open position of gate 51A. A substantially fixed portion 60 of the gate 51A is secured to the body member 22 by adhesive 62. The movable portion 64 of the gate 51A extends below the input channel 51 for preventing the gate 51A from moving clockwise beyond the solid position as shown. An area 66 has a reduced thickness for facilitating flexing of the material thus enabling the movable portion 64 to move into the phantom position upon application of light water pressure as indicated by the arrow. The fixed and movable portions 60 and 64 of the gate 51A may be a unitary plastic piece having a plastic hinge in the area defined by the reduced thickness 66.

As can be appreciated from the foregoing description, the device 10 can be readily constructed of plastic material and requiring only a limited number of parts. The chambers 24 may be filled with a buoyant material such as styrofoam or the like. The light weight of the device 10 enables the device to act as a float and a skimming device without inhibiting the normal action of a pool sweeping device 12. The instant invention has overcome the disadvantage of the prior art pool skimming devices and has made a significant contribution to the problems of swimming pool care.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention.

Now that the invention has been described what is claimed is:

1. A pool skimming device in combination with a pool sweeping device having a flexible hose interconnecting the pool sweeping device to a source of water pressure, the sweeping device comprising a surface unit and a plurality of flexible sweeping arms connected to the surface unit to propel the pool sweeping device within the pool, the improvement comprising in combination:

a body member for said pool skimming device having a specific gravity substantially less than one enabling said body member to provide buoyancy for said combination;

said body member having a central cavity communicating with an open bottom in said body member;

mounting means for rigidly mounting said body member to the surface unit of the pool sweeping device to provide floatation to the surface unit of the pool sweeping device and for moving said body member in accordance with the movement of the pool sweeping device;

filter means established relative to said open bottom of said body member;

a plurality of water input means communicating with said central cavity of said body member to enable surface water of the pool to enter said central cavity and to exit through said open bottom with said filter means collecting debris accompanying the surface water upon movement of the pool sweeping device; and said plurality of water input means including one-way gate means located on opposed sides of said body member.

2. A device as set forth in claim 1, wherein said filter means includes screen means detachably mounted to said body member.

3. A device as set forth in claim 1, wherein said mounting means includes a rigid conduit connecting the surface unit of the pool sweeping device to the flexible holse; and clamp means connecting said body member to said rigid conduit.

4. A device as set forth in claim 1, wherein said body member is a generally elliptically shaped plastic member, and said generally elliptically shaped plastic member having floatation chamber means therein.

5. A device as set forth in claim 1, wherein said body member has an open top communicating with said central cavity of said body means; and removable cover means cooperable with said body member for covering said open top.

6. A device as set forth in claim 1, wherein said body member is generally elliptically shaped, said mounting means including a rigid conduit connecting the surface unit of the pool device to the flexible hose;

mounting aperture means in opposite sides of said body member for receiving said rigid conduit; and clamp means securing said body member to said rigid conduit.

7. A device as set forth in claim 6 wherein said plurality of water input means includes said one-way gate means located on each side of said mounting aperture means.

8. A device as set forth in claim 1, wherein said filter means includes a screen having a curved region extending below said body member.

9. A device as set forth in claim 1, wherein said body member includes a rigid extending about said body member;

said filter means including a support rim extending about said filter means; and said support rim being cooperable with said ridge in a snap locking engagement for mounting said filter means to said body member.

* * * * *

UNITED STATES PATENT OFFICE

CERTIFICATE OF CORRECTION

Patent No. 4,105,557 Dated August 8, 1978

Inventor(s) Brian R. Weatherholt

It is certified that error appears in the above-identified patent and that said Letters Patent are hereby corrected as shown below:

Col. 3, line 26: after "of" insert --a--.

Col. 6, line 35: after "conduit" delete the "." insert --;and--; new paragraph should be inserted as follows --clamp means securing said body member to said rigid conduit.--

Signed and Sealed this

Eighth Day of May 1979

[SEAL]

Attest:

RUTH C. MASON
*Attesting Officer*

DONALD W. BANNER
*Commissioner of Patents and Trademarks*